United States Patent [19]

With

[11] 4,109,932

[45] Aug. 29, 1978

[54] SKI BINDING OF THE TOE BINDING TYPE

[75] Inventor: Bror With, Oslo, Norway

[73] Assignee: Witco A/S, Oslo, Norway

[21] Appl. No.: 784,646

[22] Filed: Apr. 4, 1977

[30] Foreign Application Priority Data

Apr. 6, 1976 [NO] Norway ..... 761171
Nov. 15, 1976 [NO] Norway ..... 763895

[51] Int. Cl.[2] ..... A63C 9/10
[52] U.S. Cl. ..... 280/615; 36/117
[58] Field of Search ..... 280/615, 614; 36/117

[56] References Cited

U.S. PATENT DOCUMENTS

| | | | |
|---|---|---|---|
| 1,547,618 | 7/1925 | Seeberg | 280/615 |
| 3,612,558 | 10/1971 | Sollentuna | 36/117 |
| 4,004,823 | 1/1977 | Pyzel et al. | 280/615 |

FOREIGN PATENT DOCUMENTS

| | | | |
|---|---|---|---|
| 2,265,294 | 10/1975 | France | 36/117 |
| 2,431,692 | 1/1975 | Fed. Rep. of Germany | 36/117 |
| 572,434 | 3/1933 | Fed. Rep. of Germany | 280/615 |
| 55,085 | 4/1935 | Norway | 280/615 |
| 59,295 | 4/1938 | Norway | 280/615 |
| 76,679 | 4/1950 | Norway | 280/615 |

*Primary Examiner*—David M. Mitchell
*Attorney, Agent, or Firm*—Emrich, Root, O'Keeffe & Lee

[57] ABSTRACT

A ski binding of the toe binding type having a clamping bail. The binding is intended for cooperation with a ski boot, the sole of which has edges converging in a forward direction but no laterally protruding sole rim. Instead, the boot sole has an extension in front of the upper engaged laterally by converging toe iron lugs carried by a toe iron base plate. The clamping bail is slidably mounted in slots in the toe iron lugs in a position forward of the upper and extend forwardly outside of the lugs. The forward end of the bail is mounted in a tensioning lever of the toggle type mounted forward of the toe iron lugs.

7 Claims, 10 Drawing Figures

FIG. 5.
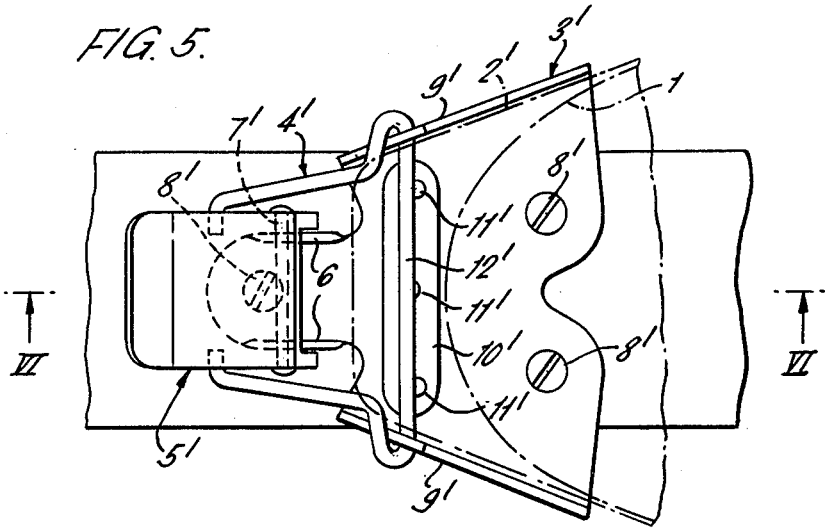
FIG. 6.
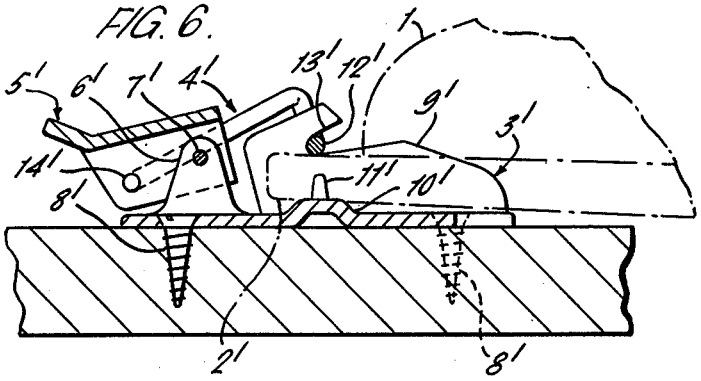
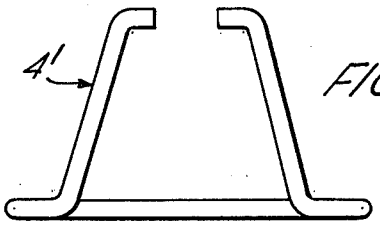
FIG. 7.
FIG. 8.
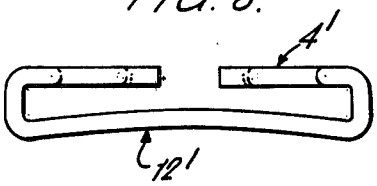

SKI BINDING OF THE TOE BINDING TYPE

FIELD OF THE INVENTION

The invention relates to ski bindings of the toe binding type having a releasable clamping member which in a clamping position holds the sole of the boot down onto the ski in an area in which the sole is arrested from being retracted.

BACKGROUND OF THE INVENTION

Due to the more and more extensive requirements for lightweight and slender cross-country skis, also narrower cross-country ski boots have been introduced in order to permit reduction of the width of the toe iron and thereby the braking effect of the toe iron lugs against the snow. An increasing importance is attached to this effect as a consequence of the competitions having developed into a struggle about seconds. Particularly, it has been attempted to reduce the width of the sole rim and thereby the toe irons to the minimum required to provide a sufficient lateral stability. At the same time it has been found desirable to shift the pivot point of the boot forward to a position in front of the foot in order to permit easier running with a great step length.

DESCRIPTION OF THE PRIOR ART

In order to meet these requirements, bindings have been developped which clamp the forward end of a beak-shaped extension of the boot sole. However, this leads to a heavy breaking load on the sole and does not constitute a satisfactory solution, at least not for uses other than by selected top racers.

SUMMARY OF THE INVENTION

The present invention aims at providing a more satisfactory solution and in doing so starts from bindings of the type initially referred to, that is the thoroughly tested binding type in which the sole rim is clamped against the ski by a clamping member, the bending of the sole thus taking place both ahead of and behind the clamped area. At the same time a departure is made from the conventional forms of clamping bails which imply a mounting above a protruding sole rim laterally of the upper. Instead, a manner of mounting is used which is well adapted for mounting in the front portion of the toe iron lugs, the operations when clamping and releasing the binding being extremely simple.

Specifically, the binding according to the invention is primarily characterized in that the clamping member is mounted in sloping guiding slots in both toe iron lugs and extend inwardly therefrom across an extension of the boot sole in front of the upper, and that the clamping member is adapted to be displaced in the slots for clamping and releasing of the binding by means of a lever mounted in front of the extension of the sole. This provides a design in which the bending load on the boot sole is distributed over a larger area, whereby it becomes possible to use a more rigid sole material which provide lateral stability. Further, the clamping mechanism may be placed in a very forward position, whereby it may be kept well inside the necessary maximum width of the toe iron and well clear of the upper.

The clamping member is suitably constituted by a wire bail which, however, does not or only to a very small extent extend rearwardly of the clamping area, especially a wire bail having transverse portions pivotally mounted partly in the toe iron lugs and partly in the lever, the legs of the bail extending on the outside of the toe iron lugs. This may be effected in two suitable ways: Either the bight portion of the bail forms the portion engaging the extension of the sole, inwardly bent end portions of the legs of the bail being inserted into the lever from either side. Or the bight of the bail may extend right through the lever, inwardly bent end portions of the legs of the bail extending through the slots and over the extension of the sole from either side. The latter alternative is presently preferred, since it allows of a better spring action against the extension of the sole, thereby preventing risk of breaking of the clamping member.

With respect to the path of the slots, they may slope for instance downwardly and rearwardly, the lever in its clamping position extending rearwardly from its mounting axis. This provides the advantage that no extra space in front of the upper is required to release the clamping member. Alternatively the slots may slope downwardly and forwardly, the lever in its clamping position extending forwardly from its mounting axis. If it is desired to space the clamping area from the upper, the second embodiment is preferred, because the mounting axis of the lever may then be positioned closer to the boot, whereby the binding as whole may be made shorter and lighter if the bearing stands for the lever are integral with the toe iron, which is to be preferred for several reasons.

The slots may be closed at both ends, but if they are open at their upper end and permit the clamping member in its released position to be raised, the removal of the boot from the binding is especially simple.

Regard being had to the fact that the sole extension extends forwardly of the clamping area and is consequently subjected to a bending load, the forward portion of the sole extension may be made particularly flexible due to a recess being formed in its bottom face, whereby the pivoting of the boot is facilitated and the risk of breaking of the sole extension is reduced.

BRIEF DESCRIPTION OF THE DRAWINGS

The invention will now be further explained by some embodiments shown in the drawing.

FIGS. 5 and 6 illustrate a further embodiment of the binding according to the invention in plan view and in a vertical section along the line VI—VI in FIG. 5, respectively.

FIGS. 7 and 8 illustrate the clamping member in the embodiment according to FIGS. 5 and 6, seen from above and from the rear end, respectively.

DETAILED DESCRIPTION OF THE PREFERRED EMBODIMENT

Figure 9:
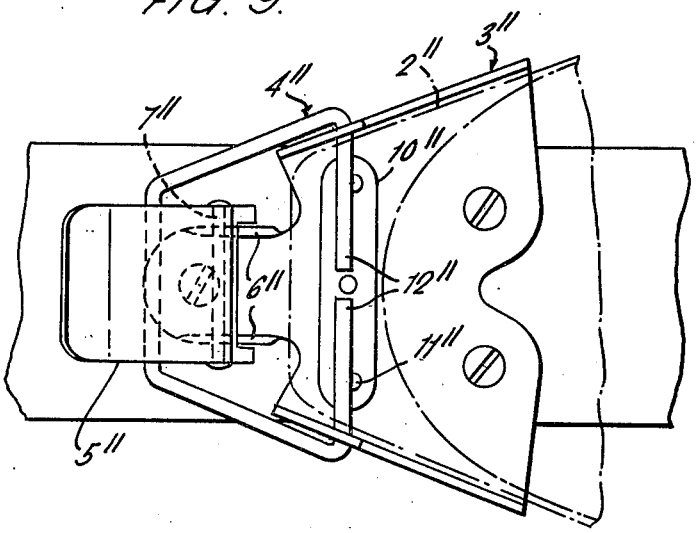
FIGS. 9 and 10 are views corresponding to FIGS. 5 and 6, but showing a third embodiment of the binding according to the invention.
Figure 10:
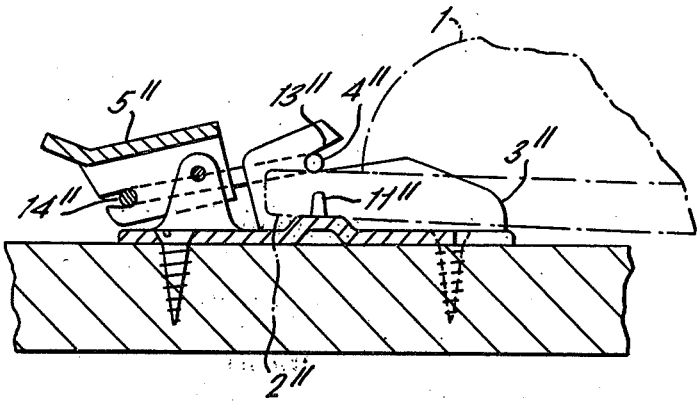

In the drawing corresponding elements of the binding in the various embodiments are designated by the same reference numerals, except that a prime has been added to the numerals in the embodiment in FIGS. 5 to 8, and a double prime has been added in the embodiment in FIGS. 9 and 10.

Figure 1:
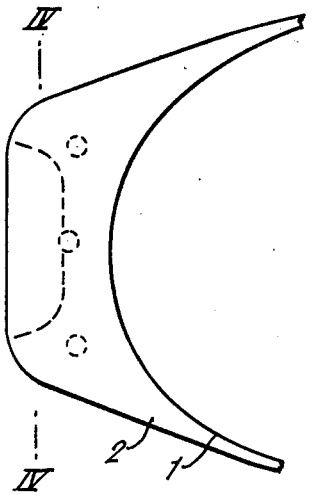
FIG. 1 is a diagrammatical plan view of the front portion of a boot shaped to match the binding.
Figure 4:
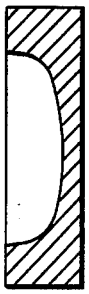
FIG. 4 shows the shape of the sole extension in section along the line IV—IV in FIG. 1.

The illustrated embodiments of the binding are intended for use with boots of a design in which the sole forms virtually no protruding rim, but follows the upper along both sides of the boot, except at the forward end, where the boot ends in a substantially trapezoidally tapering extension 2 in front of the upper 1, as indicated diagrammatically in FIG. 1.

Figure 2:
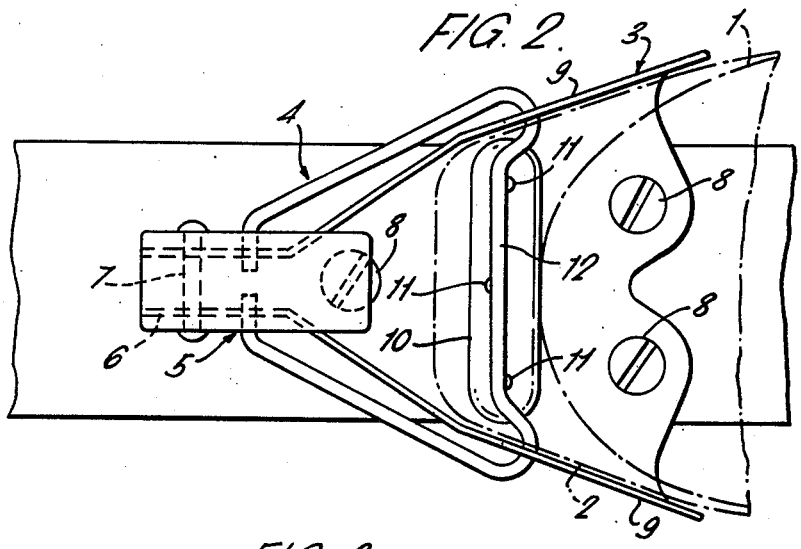
FIGS. 2 and 3 are a plan view and a side view, respectively, of a first embodiment of the binding according to the invention.
Figure 3:
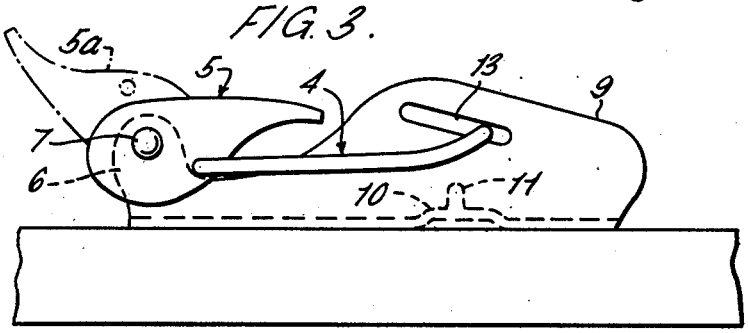

In the embodiment in FIGS. 2 and 3 the binding is constituted by a toe iron 3, a clamping member 4 and a tensioning lever 5. As shown in FIG. 2, in which the sole extension 2 is again shown in dot and dash lines, the toe iron 3 is provided with lugs 9 extending alongside the forward portion of the boot including the sole extension 2 and such a short distance rearwardly that the toe iron will not be wider than the boot. In its base plate the toe iron has a raised bead 10 carrying affixed, upwardly extending arresting pins 11 arresting the boot from being retracted and defining its pivoting point, said bead 10 at the same time facilitating the pivoting in a manner corresponding to that described in Swedish Patent specification No. 314 619. However, the bead and the pins are in the present case positioned in such a forward position that the bead will lie under the sole extension 2 with the pins 11 spaced from the upper 1.

Each of the toe iron lugs 9 are provided with a downwardly and rearwardly sloping slot 13 which mounts and guides the clamping member 4. The clamping member is formed by a wire bail, the bight portion 12 of which extends across the base plate in the area of the bead 10 to press against the upper surface of the sole extension 2 approximately above the pins 11 when the clamping member is its rearward position in the slots 13. On the outside of the toe iron lugs 9 the legs of the bail extend forwardly while converging, said legs ending in inwardly bent journals inserted from either side in the lever 5, which has a U-shaped cross-section opening towards the bottom. The level is pivotally mounted on a journal 7 mounted in a pair of bearing stands 6 shaped as a narrow extension of the toe iron 3.

As shown, the lever 5 may be pivoted from the illustrated clamping position past a dead center position to a release position, which is indicated with dash lines at 5*a*, whereby the clamping member 4 is pulled to its upper forward position in the slots 13, thus allowing the boot to be lifted from the pins 11 and retracted.

It will be seen that the clamping member 4 at both ends of the bight portion 12 has a curved portion contributing to the desired spring action. Although the wire bail 4 is mounted in the toe iron and the tensioning lever in a manner preventing the bail from being lost, mounting and dismounting of the bail is easily obtained by threading the bail through the slots 13 and resiliently expending the bail sufficiently for the journal end portions to be inserted in the lever 5. As shown in FIG. 2, the binding as a whole is very narrow, the clamping member 4 in its entirety lying well within the necessary maximum width of the toe iron.

The mounting of the binding onto the ski is effected in the conventional easy way by means of three screws 8 through the base plate of the toe iron.

In the embodiment in FIGS. 5 and 6 the toe iron 3', a bail-shaped clamping member 4' and a tensioning lever 5' mounted in bearing stands 6' on a transverse journal 7' can again be recognized. The toe iron has a raised bead 10' carrying arresting pins 11' and is formed with slots 13'.

Contrary to the embodiment in FIG. 1 the slots 13' slope forwardly and downwardly and the tensioning lever 5' is correspondingly adapted to be pivoted forwardly for tensioning. Since the lever 5' thus requires little space rearwardly of the journal 7', the toe may be shorter than in the first embodiment. Further, the slots 13 are open at their upper end which in the embodiment shown is the rear end, permitting the boot with the boot extension 2 to be lifted upwardly from the pins 11' in the released position of the clamping member 4' at the rear end of the slots, in spite of the fact that the bight portion 12' in this position lies adjacent to the upper 1. The upper edge of the toe iron lugs 3' rearwardly of the slots 13 are aligned with the lower edge of the slots, so that the clamping member 4' will readily slide into the slots during the clamping operation. In clamped position, in which the bight portion 12' of the clamping bail abuts against the end of the slots 13', the mounting points 14' of the free end portions of the bail in the tensioning lever 5' lies below a plane through the bight portion 12' and the journal 7', so that the lever 5' also in this case passes a dead center position during the clamping operation.

In this embodiment the bight portion 12' of the bail has no curved portion in plan view in the area inside the slots 13'. Therefore, the clamping member will be more heavily stressed. However, experience has shown that the risk of breaking may be counteracted by a slightly concave path of the bight portion in elevation as shown in FIG. 8.

An embodiment which provides a still better security against break, is shown in FIGS. 9 and 10. This embodiment is substantially the same as that illustrated in FIGS. 5 to 8, except for the shape and the positioning of the clamping member. Again, the clamping member is constituted by a wire bail 4'' being guided in rearwardly open slots in the toe iron lugs. However, the bight portion of the bail extends right through the tensioning lever 5'', whereas its clamping portion is formed by inwardly bent end portions 12'' of the bail legs, said end portions extending inwardly above the bead 10''. These end portions 12'' may yield resiliently during clamping and use, generating a torsional stress in the longitudinal bail legs, whereby the risk of breaking the bail is effectively eliminated.

In order also in this embodiment to permit final shaping of the bail before mounting, the bail is not threaded through the tensioning lever 5'', but inserted in forwardly open slots 14'' provided in the flanges of the lever, said slots being subsequently pinched together at the entrance in order to secure the clamping member so that it cannot be lost.

The invention is not restricted to the described and illustrated embodiments, the design being variable in many respects within the scope of the invention. It is, for instance, conceivable not to make the inclined guiding means for the clamping member integral with the rest of the toe iron. For example, it is possible to provide the inclined guiding in a separate plate member adjustably secured to the fixed part of the toe iron. Neither is it necessary that the arresting of the boot against retraction takes place by means of conventional pins 11. Rather, the arresting may be obtained in any suitable manner. As an example, in embodiments in which the clamping movement is a forward movement, the clamping portion (12' or 12'') of the clamping member may cooperate with studs on the upper surface of the sole extension in a manner corresponding to that shown and described in Swedish Patent specification No. 360 265.

What I claim is:

1. A ski binding for fastening to a ski a ski boot having an upper boot portion and a lower frontal sole portion extending ahead of said upper portion, including in combination:

a toe iron positioned on the ski and adapted to receive the ski boot and having forwardly converging lateral lugs thereon, said toe iron including a base plate adapted to engage the frontal sole portion of the boot and each of said lateral lugs formed with an inclined slotted opening therein positioned ahead of the upper boot portion to be fastened to the ski, arresting means engageable with the sole portion of the ski boot to prevent the boot from being longitudinally retracted from the ski binding, a toggle lever mounted to a fixed support positioned on the ski for cooperating with said toe iron, said toggle lever being pivotally movable in a vertical longitudinal plane between a clamping position and an open position, and a clamping bail cooperating with said toggle lever and movable thereby, said clamping bail including a rear transverse portion extending through said inclined slotted opening in each of said lateral lugs and engageable with the upper surface of the frontal sole portion of the boot when the ski boot is inserted into the toe iron and said toggle lever is pivotally moved to the clamping position, a frontal transverse portion pivotally engageable with said toggle lever and leg portions interconnecting said rear transverse portion with said frontal transverse portion, with one of said transverse portions being interrupted between its ends.

2. A ski binding in accordance with claim 1 wherein said toggle lever is single-armed and said inclined slotted openings in each of said lateral lugs slope downwardly and rearwardly thereof with respect to the mounting of said toggle lever on the ski and said toggle lever when in the clamping position extends rearwardly from its fixed support mounting on the ski and that the rear transverse portion of said bail in released position is positioned forwardly of the frontal sole portion to permit upward removal of the boot from the binding.

3. The ski binding in accordance with claim 1 wherein said toggle lever is single-armed and said inclined slotted openings in each of said lateral lugs slope downwardly and forwardly with respect to the mounting of said toggle lever on the ski and said toggle lever extends forwardly from its fixed support on the ski when in the clamping position.

4. The ski binding in accordance with claim 1 wherein said inclined slotted openings in each of said lateral lugs are open at their upper end thereof to permit said clamping bail when in the open position to be released therefrom.

5. The ski binding in accordance with claim 2 wherein said inclined slotted openings in each of said lateral lugs are closed at their forward and rearward ends.

6. The ski binding in accordance with claim 1 wherein said rear transverse portion of said clamping bail is interrupted.

7. The ski binding in accordance with claim 1 wherein said frontal sole portion of the ski boot includes a recess on the bottom face thereof.

* * * * *